US009764183B2

(12) United States Patent
Roepke

(10) Patent No.: US 9,764,183 B2
(45) Date of Patent: Sep. 19, 2017

(54) QUICK-RELEASE CLAMP ASSEMBLY FOR WEIGHTLIFTING BAR

(71) Applicant: Brad Roepke, Waterville, KS (US)

(72) Inventor: Brad Roepke, Waterville, KS (US)

( * ) Notice: Subject to any disclaimer, the term of this patent is extended or adjusted under 35 U.S.C. 154(b) by 31 days.

(21) Appl. No.: 14/989,519

(22) Filed: Jan. 6, 2016

(65) Prior Publication Data

US 2016/0193494 A1 Jul. 7, 2016

Related U.S. Application Data

(60) Provisional application No. 62/100,192, filed on Jan. 6, 2015.

(51) Int. Cl.
*A63B 21/072* (2006.01)
*A63B 21/075* (2006.01)

(52) U.S. Cl.
CPC ..... *A63B 21/0728* (2013.01); *A63B 21/072* (2013.01); *A63B 21/0722* (2015.10); *A63B 21/0724* (2013.01)

(58) Field of Classification Search
CPC ..... A63B 21/00
USPC ..... 482/106, 108
See application file for complete search history.

(56) References Cited

U.S. PATENT DOCUMENTS

| | | | |
|---|---|---|---|
| 4,639,979 | A | 2/1987 | Polson |
| 5,295,933 | A | 3/1994 | Ciminski et al. |
| 7,087,000 | B1 | 8/2006 | Walker |
| 8,671,530 | B2 | 3/2014 | Ciminski et al. |
| 8,827,878 | B1 | 9/2014 | Ciminski et al. |

*Primary Examiner* — Nyca T Nguyen
(74) *Attorney, Agent, or Firm* — Jeffrey L. Thompson; Thompson & Thompson, P.A.

(57) ABSTRACT

A quick-release clamp assembly for a weightlifting bar has first and second clamp members connected together by a pivot connection for rotation about a pivot axis. The first and second members are movable about the pivot axis between an open position in which the clamp assembly can be placed on and removed from the weightlifting bar, and a closed position in which the clamp assembly is clamped securely onto the weightlifting bar. The first clamp member has first and second resilient bar engaging structures spaced from the pivot axis. An adjustable third bar engaging structure projects inwardly from the second clamp member adjacent to the pivot axis. The third bar engaging structure is arranged to engage an outer surface of the weightlifting bar and to move to an over-center locking condition when the first and second clamp members move from their open position to their closed position.

20 Claims, 4 Drawing Sheets

QUICK-RELEASE CLAMP ASSEMBLY FOR WEIGHTLIFTING BAR

RELATED APPLICATIONS

This application claims priority of U.S. Provisional Patent Application No. 62/100,192 filed on Jan. 6, 2015. The contents of the provisional application are incorporated herein by reference.

BACKGROUND OF THE INVENTION

Field of the Invention

The present invention relates generally to weightlifting equipment and, in particular, to devices for securing plates on a weightlifting bar.

Description of the Related Art

Strength training is an important part of an exercise program to promote long-term health and well-being. Free weights, such as barbells and dumbbells, and resistance machines are commonly used for strength training. Free weights are favored by many fitness experts.

Two common forms of free weights are barbells and dumbbells. Barbells typically have one or more weights in the form of disc-shaped plates at each end of a bar and are intended to be lifted using two arms. Dumbbells are similar but have a shorter bar and are intended to be lifted using only one arm. These devices are used in various exercises to develop strength by providing resistance to muscles.

Weightlifting bars for barbells and dumbbells are typically designed to allow the weight at the ends of the bars to be adjusted. Disc-shaped plates with central openings are slid onto the ends of the weightlifting bars to adjust the weight. These plates are retained on the weightlifting bar by placing them against a fixed stop on the inward portion of the bar and securing the weights with a collar placed on the outer end of the bar. The collar can be locked in place with a set screw or a clamp assembly. Examples of clamp assemblies for weightlifting bars have been disclosed in U.S. Pat. Nos. 4,639,979, 5,295,933, 8,671,530, and 8,827,878.

There is a need for an improved quick-release clamp assembly for weightlifting bars.

SUMMARY OF THE INVENTION

An object of the present invention is to provide a clamp assembly for a weightlifting bar that can be quickly and securely clamped to, and easily released from, the weightlifting bar.

A further object of the present invention is to provide a clamp assembly for a weightlifting bar that can be manufactured efficiently using extruded components.

A further object of the present invention is to provide a clamp assembly that can be adjusted to accommodate variations in the outer diameters of standard weightlifting bars.

A further object of the present invention is to provide a quick-release clamp assembly that provides a safe and secure clamping action on a weightlifting bar, is easy to use, efficient and inexpensive to manufacture, adjustable to accommodate variations in standard weightlifting bar diameters, and capable of a long operating life.

To accomplish these and other objects of the present invention, a quick-release clamp assembly is provided for weightlifting bars. The clamp assembly has first and second clamp members connected together by a pivot connection for rotation about a pivot axis. The first and second members are movable about the pivot axis between an open position in which the clamp assembly can be placed on and removed from the weightlifting bar, and a closed position in which the clamp assembly is clamped securely onto the weightlifting bar. The first clamp member has first and second resilient bar engaging structures spaced from the pivot axis. An adjustable third bar engaging structure projects inwardly from the second clamp member adjacent to the pivot axis. The third bar engaging structure is arranged to engage an outer surface of the weightlifting bar and to move to an over-center locking condition when the first and second clamp members move from their open position to their closed position.

According to one aspect of the present invention, a quick-release clamp assembly and a weightlifting bar are provided in combination, the weightlifting bar comprising a longitudinal axis and a cylindrical outer surface, and the clamp assembly comprising: first and second clamp members pivotally connected together for rotation relative to each other about a pivot axis, the first and second members being pivotally movable about the pivot axis between an open position in which the clamp assembly can be placed on and removed from the weightlifting bar and a closed position in which the clamp assembly is clamped securely onto the weightlifting bar, the pivot axis and the longitudinal axis lying in the same plane when the clamp assembly is clamped onto the weightlifting bar, and the pivot axis being parallel to the longitudinal axis of the weightlifting bar when the clamp assembly is clamped onto the weightlifting bar. The first and second clamp members have first and second inner surfaces, respectively, facing inwardly toward the outer surface of the weightlifting bar when the clamp assembly is in the closed position. The first clamp member has first and second bar engaging structures spaced circumferentially along the first inner surface from the pivot axis. The second clamp member has third and fourth bar engaging structures, the third bar engaging structure projecting inwardly from the second clamp member for engagement with the outer surface of the weightlifting bar when the clamp assembly is clamped onto the weightlifting bar. A bar engaging portion of the third bar engaging structure is arranged to move from one side of the plane containing the pivot axis and the longitudinal axis to another side of the plane when the first and second clamp members are moved from the open position to the closed position, thereby causing the third bar engaging structure to be held in an over-center condition when the first and second clamp members are in the closed position.

According to another aspect of the present invention, a quick-release clamp assembly for a weightlifting bar is provided, comprising: first and second clamp members connected together by a pivot connection for rotation relative to each other about a pivot axis, the first and second members being pivotally movable about the pivot axis between an open position in which the clamp assembly can be placed on and removed from the weightlifting bar and a closed position in which the clamp assembly is clamped securely onto the weightlifting bar. The first and second clamp members have first and second inner surfaces, respectively, that face inwardly toward each other when the clamp assembly is in the closed position. The first clamp member has first and second bar engaging structures spaced along the first inner surface from the pivot axis. The second clamp member has a third bar engaging structure projecting inwardly from the second clamp member. The third bar engaging structure is arranged to engage an outer surface of the weightlifting bar and move to an over-center locking condition when the first and second clamp members move from the open position to the closed position.

Numerous other objects of the present invention will be apparent to those skilled in this art from the following description wherein there is shown and described an embodiment of the present invention, simply by way of illustration of one of the modes best suited to carry out the invention. As will be realized, the invention is capable of other different embodiments, and its several details are capable of modification in various obvious aspects without departing from the invention. Accordingly, the drawings and description should be regarded as illustrative in nature and not restrictive.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A quick-release clamp assembly 10 according to the present invention will now be described in detail with reference to FIGS. 1 to 12 of the accompanying drawings.

Figure 1:
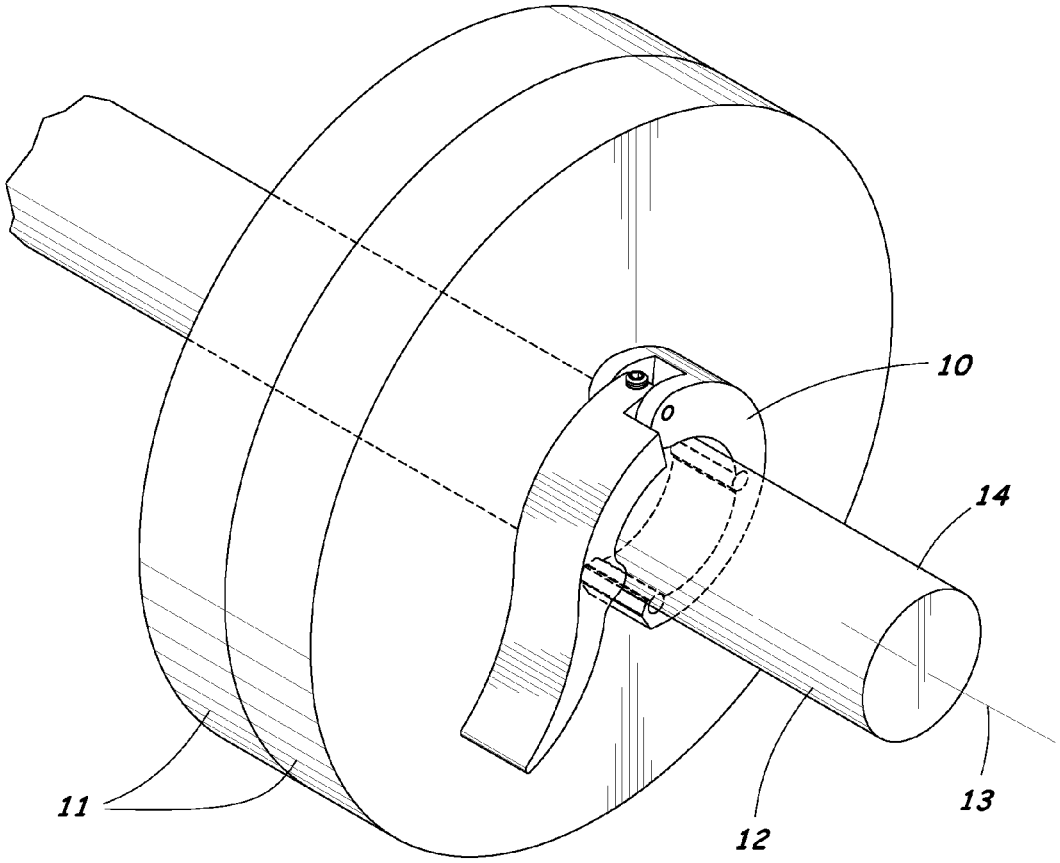
FIG. 1 is a perspective view of the quick-release clamp assembly of the present invention being used to secure plates on a weightlifting bar.

As shown in FIG. 1, the clamp assembly 10 is used to secure a first set of plates 11 on one end of a weightlifting bar 12. Plates 11 are available in various sizes and weights and are used to add a selected amount of weight to the weightlifting bar 12. A corresponding second set of plates (not shown) and second clamp assembly 10 are provided on the other end of the weightlifting bar 12.

The weightlifting bar 12 can be, for example, a standard Olympic weightlifting bar with a longitudinal axis 13 and a cylindrical outer surface 14. An Olympic weightlifting bar 12 has a nominal two inch (2") outer diameter. However, due to manufacturing differences and tolerances, it is common for Olympic weightlifting bars to have a range of outer diameters, some of which are slightly greater than two inches, and some of which are slightly less than two inches. The clamp assembly 10 of the present invention can be adjusted to accommodate such variances in the outer diameters of standard size Olympic weightlifting bars 12.

The clamp assembly 10 includes a first clamp member 15 and a second clamp member 16. The first and second clamp members 15, 16 are pivotally connected together for rotation relative to each other about a pivot axis 17. The pivot axis 17 is defined by a pivot pin 18 extending through aligned bores 19, 20, 21 in the connected ends of the first and second clamp members 15, 16. The aligned bores 19, 20 are formed in a pair of legs 22, 23 at the end of the first clamp member 15, and the bore 21 is formed in a mating structure 24 at the end of the second clamp member 16. The mating structure 24 of the second clamp member 16 fits between the pair of legs 22, 23 of the first clamp member 15.

Figure 2:
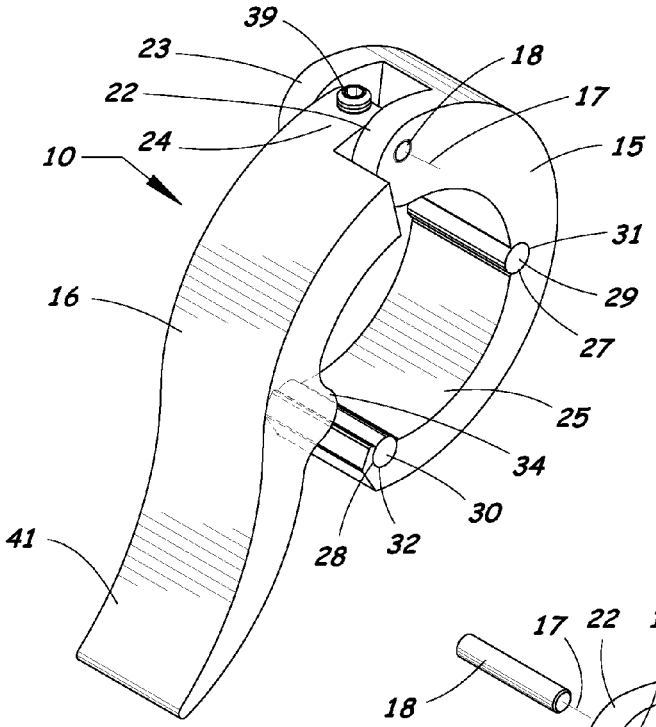
FIG. 2 is a perspective view of the quick-release clamp assembly shown in FIG. 1.
Figure 3:
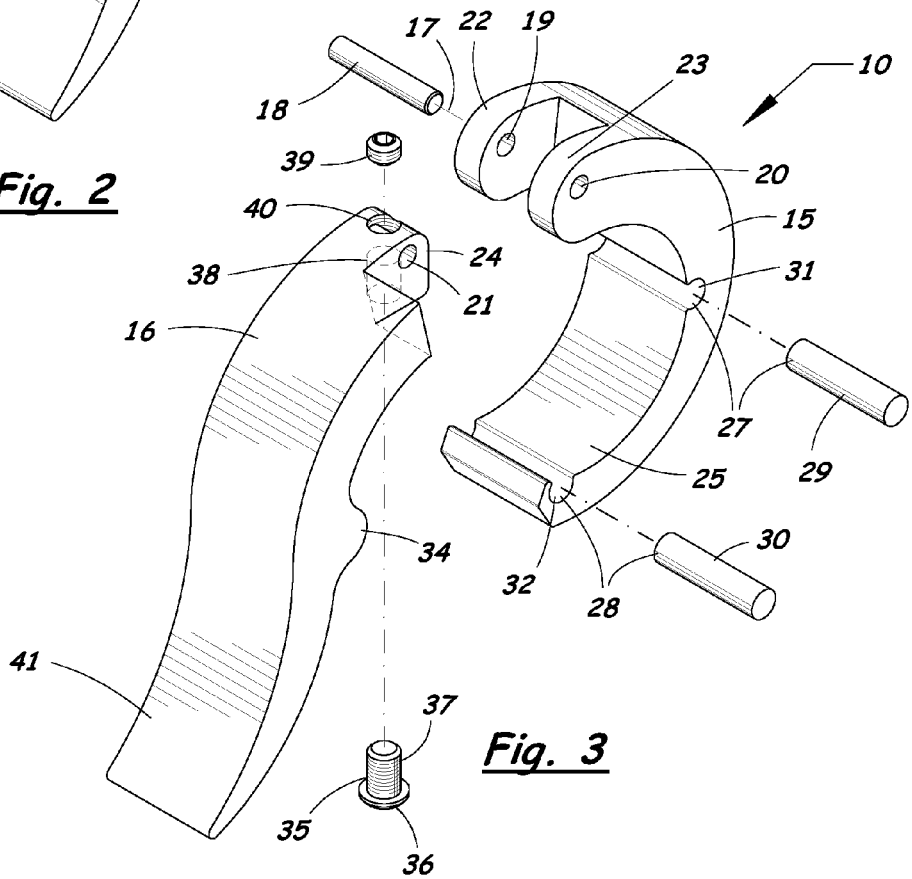
FIG. 3 is an exploded perspective view of the quick-release clamp assembly.
Figure 5:
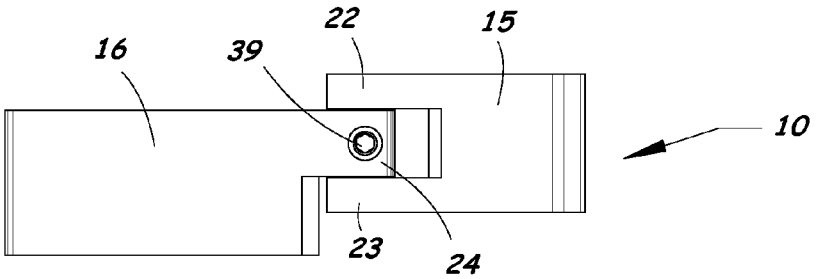
FIG. 5 is a top view of the quick-release clamp assembly.
Figure 4:
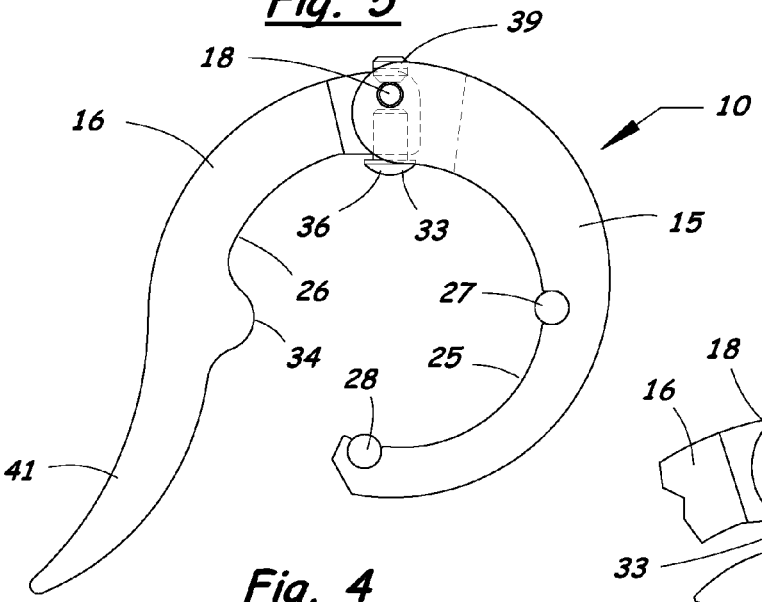
FIG. 4 is an end view of the quick-release clamp assembly.
Figure 12:
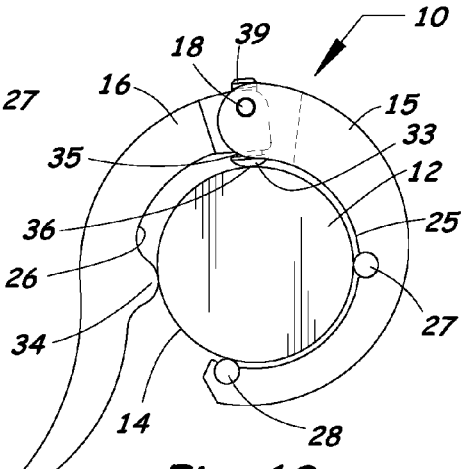
FIG. 12 is an end view of the quick-release clamp assembly in its closed position clamped securely onto the weightlifting bar.

The first and second clamp members 15, 16 are pivotally movable about the pivot axis 17 between an open position (shown in FIGS. 9 and 10) and a closed position (shown in FIGS. 1, 2 and 12). In the open position, the clamp assembly 10 can be placed on and removed from the weightlifting bar 12. In the closed position, the clamp assembly 10 is clamped securely onto the weightlifting bar 12. When the clamp assembly 10 is clamped onto the weightlifting bar 12, the pivot axis 17 of the clamp assembly 10 is parallel and coplanar to the longitudinal axis 13 of the weightlifting bar 12.

The first clamp member 15 has a first inner surface 25, and the second clamp member 16 has a second inner surface 26. The first and second inner surfaces 25, 26 face inwardly toward each other and toward the outer surface 14 of the weightlifting bar 12 when the clamp assembly 10 is in its closed position.

The first clamp member 15 has an arcuate shape with first and second bar engaging structures 27, 28 spaced circumferentially along the first inner surface 25 from the pivot axis 17. The arcuate shape of the first clamp member 15 extends slightly more than 180 degrees (e.g., 190 to 200 degrees) around the outer cylindrical surface 14 of the weightlifting bar 12.

The first and second bar engaging structures 27, 28 comprise resilient elements 29, 30 that protrude inwardly from the first inner surface 25 of the first clamp member 15. The resilient elements 29, 30 are fixed within first and second grooves 31, 32 formed in the first inner surface 25 of the first clamp member 15. The first and second grooves 31, 32 have a shape of a cylindrical segment and extend across the width of the inner surface 25 of the first clamp member 15. The resilient elements 29, 30 are cylindrical elements that fit into the first and second grooves 31, 32 and extend generally parallel with the pivot axis 17 and the longitudinal axis 13 of the weightlifting bar 12.

The resilient elements 29, 30 can be fixed within the grooves 31, 32 using an adhesive to prevent the resilient elements 29, 30 from becoming separated from the grooves 31, 32. Alternatively, the resilient elements 29, 30 and grooves 31, 32 can be formed so that the resilient elements 29, 30 fit sufficiently tight to trap the resilient elements 29, 30 within the grooves. For example, the grooves 31, 32 can have a cross-section of approximately 190 to 200 degrees of a circle to maintain the resilient elements 29, 30 within the grooves 31, 32. The resilient elements 29, 30 can have a slightly larger diameter than the diameter of the grooves 31, 32 to create a tight friction fit between the grooves 31, 32 and the resilient elements 29, 30.

In a preferred embodiment, the first clamp member 15 comprises a rigid metal body, and the resilient elements 29, 30 are made of a rubber material. The flexibility and compressibility of the resilient elements 29, 30 allows the clamp assembly 10 to accommodate slight variations in the outer diameter of the weightlifting bar 12, while still maintaining a secure and tight fit on the bar 12.

The second clamp member 16 has third and fourth bar engaging structures 33, 34. The third bar engaging structure 33 projects inwardly from the second clamp member 16 for engagement with the outer surface 14 of the weightlifting bar 12 when the clamp assembly 10 is clamped onto the weightlifting bar 12.

The third bar engaging structure 33 includes a threaded element 35, such as a threaded bolt, that can be adjusted to vary a clamping force of the clamp assembly 10 on the weightlifting bar 12. The threaded element 35 has a head 36 and a threaded shaft 37. The threaded shaft 37 is received into a first threaded bore 38 in the second clamp member 16, which is substantially perpendicular to the pivot axis 17. The head 36 of the threaded element 35 provides the bar engaging portion of the third bar engaging structure 33.

The bar engaging portion of the third bar engaging structure 33 is arranged to move to an over-center locking condition when the first and second clamp members 15, 16 move from their open position to their closed position. The over-center locking condition is created by the bar engaging portion of the head 36 moving from one side of the plane containing the pivot axis 17 and the longitudinal axis 13 of the weightlifting bar 12 to the other side of such plane when the first and second clamp members 15, 16 move from their open position to their closed position.

The bar engaging points created by the first, second and third bar engaging structures 27, 28, 33 are angularly spaced around the outer cylindrical surface 14 of the weightlifting bar 12 by an angle greater than 180 degrees (for example, 190 to 200 degrees). That is, a subtending angle of an arc containing the first, second and third bar engaging structures 27, 28, 33 relative to the longitudinal axis 13 of the weightlifting bar 12 is greater than 180 degrees.

A threaded set screw 39 is received in a second threaded bore 40 of the second clamp member 16. The second threaded bore 40 is substantially perpendicular to the pivot axis 17 and located on an opposite side of the pivot axis 17 from the first threaded bore 38. The first and second threaded bores 38, 40 can be coaxial and formed in the same boring and threading operation for manufacturing efficiency.

The threaded element 35 and set screw 39 are located in the first and second threaded bores 38, 40, respectively, on opposite sides of the pivot pin 18. The set screw 39 is operable to engage and lock the pin 18 within the bore 21 of the second clamp member 16 to prevent the pin 18 from sliding out of the bores 19-21 in the first and second clamp members 15, 16.

The fourth bar engaging structure 34 is a projection formed on the second clamp member 16 that protrudes inwardly toward the weightlifting bar 12. The fourth bar engaging structure 34 only contacts the outer surface 14 of the weightlifting bar 12 when the clamp assembly 10 is in its fully closed position.

A handle portion 41 of the second clamp member 16 protrudes outwardly beyond the fourth bar engaging structure 34 and the free end of the first clamp member 15 when the clamp assembly 10 is in its closed position. The handle portion 41 provides additional leverage to facilitate moving the first and second clamp members 15, 16 between their open and closed positions.

The first clamp member 15 is a segment of an extruded metal object having a fixed cross-sectional profile. The extruded object is machined at its one end portion to form the legs 22, 23 to accommodate the pivotal connection to the second clamp member 16.

The second clamp member 16 is a segment of an extruded metal object having a fixed cross-sectional profile. The extruded object is machined at its one end portion to form the mating portion 24 to accommodate the pivotal connection to the first clamp member 15.

Figure 9:
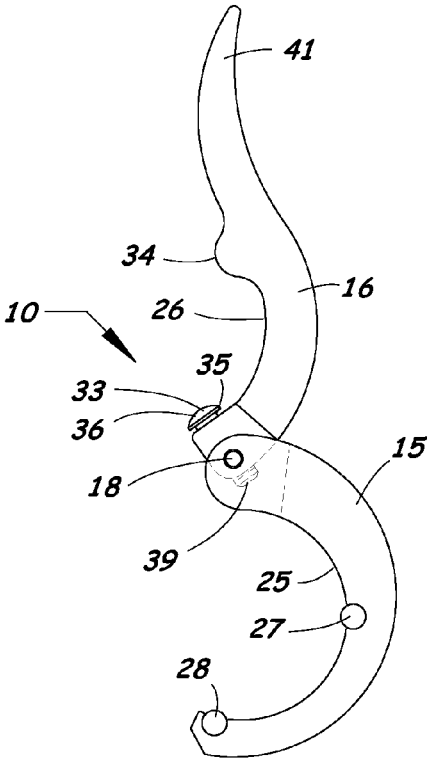
FIG. 9 is an end view of the quick-release clamp assembly in an open position.
Figure 10:
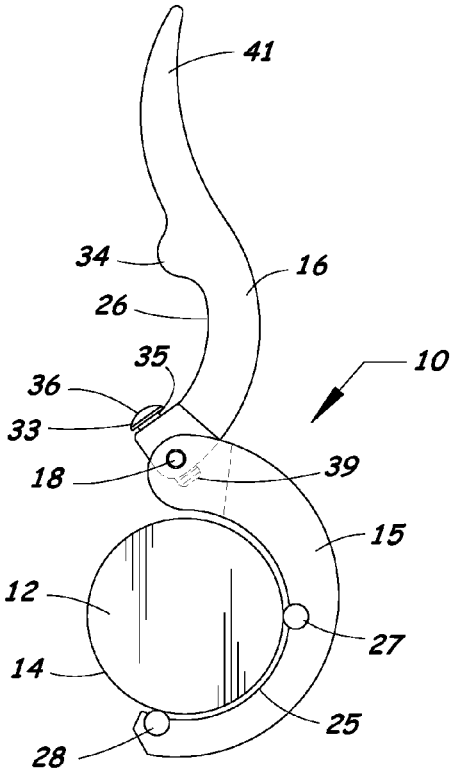
FIG. 10 is an end view of the quick-release clamp assembly in its open position positioned around a weightlifting bar.
Figure 11:
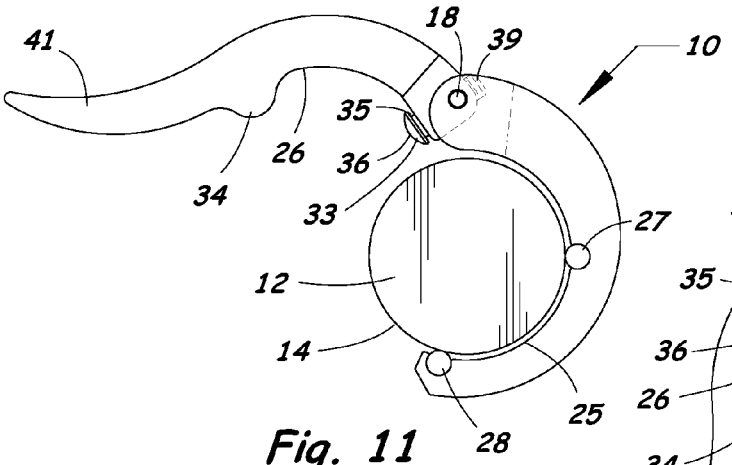
FIG. 11 is an end view of the quick-release clamp assembly showing an intermediate position of the clamp members between their open position and their closed position.

In use, the clamp assembly 10 in its open position is placed over the weightlifting bar 12, as shown in FIGS. 9 and 10. The clamp assembly 10 is then moved to its closed position over the weightlifting bar 12 by pivoting the second clamp member 16 relative to the first clamp member 15 to the position shown in FIGS. 11 and 12.

Figure 7:
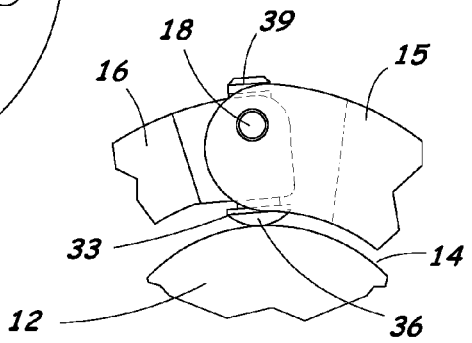
FIG. 7 is a detail view showing the adjustable threaded member in a first position of adjustment.
Figure 6:
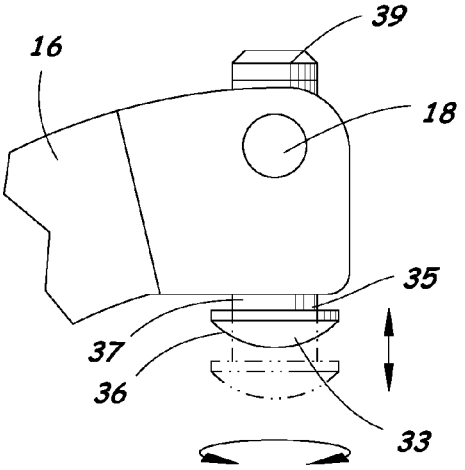
FIG. 6 is an enlarged detail view of a segment of the clamp assembly containing an adjustable threaded member for adjusting the clamping force of the clamp assembly to accommodate variations in the outer diameter of a standard weightlifting bar.
Figure 8:
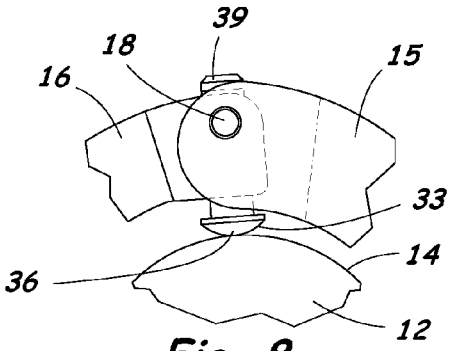
FIG. 8 is a detail view showing the adjustable threaded member in a second position of adjustment.

If the clamp assembly 10 is determined to be too loose on the weightlifting bar 12, then the clamp assembly 10 can be removed and the threaded element 35 moved to a more extended position, as shown in FIG. 8. If the clamp assembly 10 is determined to be too tight on the weightlifting bar 12 or cannot be moved to its closed position, then the clamp assembly 10 can be removed and the threaded element 35 moved to a more retracted position, as shown in FIG. 7.

Once the proper adjustment is made, then the clamp assembly 10 can be reinstalled over the weightlifting bar 12 and moved to its closed position with the desired amount of clamping force. With the threaded element 35 properly adjusted, the clamp assembly 10 is held securely on the weightlifting bar 12 with the proper clamping force when the clamp assembly 10 is in its closed position, and the head 36 of the threaded element 35 is held in an over-center locking condition. The clamp assembly 10 can be easily removed and reinstalled to change the plates 11 on the weightlifting bar 12 during use.

While the invention has been specifically described in connection with specific embodiments thereof, it is to be understood that this is by way of illustration and not of limitation, and the scope of the appended claims should be construed as broadly as the prior art will permit.

What is claimed is:

1. In combination, a quick-release clamp assembly and a weightlifting bar, the weightlifting bar comprising a longitudinal axis and a cylindrical outer surface, and said clamp assembly comprising:

first and second clamp members pivotally connected together for rotation relative to each other about a pivot axis, said first and second members being pivotally movable about said pivot axis between an open position in which the clamp assembly can be placed on and removed from the weightlifting bar and a closed position in which the clamp assembly is clamped securely onto the weightlifting bar, said pivot axis and said longitudinal axis lying in the same plane when the clamp assembly is clamped onto the weightlifting bar, and said pivot axis being parallel to the longitudinal axis of the weightlifting bar when the clamp assembly is clamped onto the weightlifting bar;

said first and second clamp members having first and second inner surfaces, respectively, facing inwardly toward the outer surface of said weightlifting bar when the clamp assembly is in said closed position;

said first clamp member having first and second bar engaging structures spaced circumferentially along said first inner surface from said pivot axis;

said second clamp member having third and fourth bar engaging structures, said third bar engaging structure projecting inwardly from said second clamp member for engagement with the outer surface of the weightlifting bar when the clamp assembly is clamped onto the weightlifting bar; and a bar engaging portion of said third bar engaging structure being arranged to move from one side of the plane containing said pivot axis and said longitudinal axis to another side of said plane when said first and second clamp members are moved from said open position to said closed position, thereby causing said third bar engaging structure to be held in an over-center condition when said first and second clamp members are in said closed position.

2. The combination according to claim 1, wherein said first clamp member comprises a rigid metal body, and said first and second bar engaging structures comprise resilient elements protruding inwardly from the first inner surface of said first clamp member.

3. The combination according to claim 2, wherein said first clamp member comprises first and second grooves formed in said first inner surface, and said resilient elements are fixed within said first and second grooves.

4. The combination according to claim 3, wherein said first and second grooves have a shape of a cylindrical segment, and said resilient members are cylindrical.

5. The combination according to claim 4, wherein said resilient members comprise a rubber material.

6. The combination according to claim 1, wherein a subtending angle of an arc containing said first, second and third bar engaging structures relative to the longitudinal axis of the weightlifting bar is greater than 180 degrees.

7. The combination according to claim 1, wherein said third bar engaging structure comprises a threaded element that can be adjusted to vary a clamping force of the clamp assembly on the weightlifting bar.

8. The combination according to claim 7, wherein said threaded element comprises a head and a threaded shaft, said threaded shaft being substantially perpendicular to said pivot axis, and said head comprising said bar engaging portion of said third bar engaging structure.

9. The combination according to claim 8, wherein said fourth bar engaging structure comprises a projection formed on said second clamp member that protrudes inwardly toward said weightlifting bar.

10. The combination according to claim 8, wherein said second clamp member comprises a handle portion that protrudes outwardly beyond a free end of said first clamp member to facilitate moving said first and second clamp members between said open and closed positions.

11. The combination according to claim 1, wherein said pivot axis comprises a pivot pin extending through aligned bores in said first and second clamp members.

12. The combination according to claim 11, further comprising a threaded set screw received in a threaded bore of one of said first and second clamp members, said set screw being substantially perpendicular to said pin and being operable to engage and lock said pin within said one of said first and second clamp members.

13. The combination according to claim 1, wherein said first clamp member comprises a segment of an extruded object having a fixed cross-sectional profile with a machined end portion to accommodate the pivotal connection to said second clamp member.

14. The combination according to claim 1, wherein said second clamp member comprises a segment of an extruded object having a fixed cross-sectional profile with a machined end portion to accommodate the pivotal connection to said first clamp member.

15. A quick-release clamp assembly for a weightlifting bar, comprising:

first and second clamp members connected together by a pivot connection for rotation relative to each other about a pivot axis, said first and second members being pivotally movable about said pivot axis between an open position in which the clamp assembly can be placed on and removed from the weightlifting bar and a closed position in which the clamp assembly is clamped securely onto the weightlifting bar;

said first and second clamp members having first and second inner surfaces, respectively, that face inwardly toward each other when the clamp assembly is in said closed position;

said first clamp member having first and second bar engaging structures spaced along said first inner surface from said pivot axis;

said second clamp member having a third bar engaging structure projecting inwardly from said second clamp member, said third bar engaging structure being arranged to engage an outer surface of the weightlifting bar and move to an over-center locking condition when said first and second clamp members move from said open position to said closed position.

16. The clamp assembly according to claim 15, wherein said first clamp member comprises a rigid metal body, and said first and second bar engaging structures comprise resilient elements protruding inwardly from the inner surface of said first clamp member.

17. The clamp assembly according to claim 16, wherein said first clamp member comprises first and second grooves formed in the inner surface of said first clamp member, and said resilient elements are fixed within said first and second grooves.

18. The clamp assembly according to claim 15, wherein a subtending angle of an arc containing said first, second and third bar engaging structures is greater than 180 degrees.

19. The clamp assembly according to claim 15, wherein said third bar engaging structure comprises a threaded element that can be adjusted to vary a clamping force of the clamp assembly on the weightlifting bar, said threaded element comprising a bar engaging head and a threaded shaft, said threaded shaft being substantially perpendicular to said pivot axis.

20. The clamp assembly according to claim 15, wherein said first and second clamp members each comprises a segment of an extruded object having a fixed cross-sectional profile with a machined end portion to accommodate the pivotal connection between said first and second clamp members.

* * * * *